US008154373B2

(12) United States Patent
Colsch et al.

(10) Patent No.: US 8,154,373 B2
(45) Date of Patent: Apr. 10, 2012

(54) CIRCUIT BREAKER-LIKE APPARATUS WITH COMBINATION CURRENT TRANSFORMER

(75) Inventors: Susan Jean Walker Colsch, Shellsburg, IA (US); David Joseph Dunne, Cedar Rapids, IA (US); Kevin John Malo, Iowa City, IA (US); Richard Allen Studer, II, Wesley, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 361 days.

(21) Appl. No.: 11/818,679

(22) Filed: Jun. 15, 2007

(65) Prior Publication Data

US 2008/0012677 A1 Jan. 17, 2008

Related U.S. Application Data

(60) Provisional application No. 60/831,006, filed on Jul. 14, 2006.

(51) Int. Cl.
*H01F 17/06* (2006.01)
*H01F 38/20* (2006.01)
*H01F 27/24* (2006.01)

(52) U.S. Cl. ..... 336/178; 336/173; 336/212; 336/234

(58) Field of Classification Search ..... 336/173, 336/178, 212, 234
See application file for complete search history.

(56) References Cited

U.S. PATENT DOCUMENTS

| | | | | | |
|---|---|---|---|---|---|
| 3,345,486 | A | * | 10/1967 | Colclaser, Jr. et al. | 218/87 |
| 3,403,362 | A | * | 9/1968 | Strom | 335/174 |
| 3,678,372 | A | * | 7/1972 | Elder | 323/342 |
| 3,962,606 | A | * | 6/1976 | Burns et al. | 361/45 |
| 4,301,435 | A | | 11/1981 | Castonguay et al. | 335/26 |
| 4,679,019 | A | | 7/1987 | Todaro et al. | 335/172 |
| 4,757,420 | A | * | 7/1988 | Saletta et al. | 361/187 |
| 4,951,052 | A | | 8/1990 | Jacob et al. | 341/122 |
| 4,992,723 | A | | 2/1991 | Zylstra et al. | 323/284 |
| 5,014,025 | A | | 5/1991 | Papallo, Jr. et al. | 335/167 |
| 5,015,983 | A | * | 5/1991 | DeRosier et al. | 336/180 |
| 5,038,246 | A | * | 8/1991 | Durivage, III | 361/93.2 |
| 5,124,875 | A | | 6/1992 | Ishii et al. | 361/93 |
| 5,276,416 | A | | 1/1994 | Ozaki | 335/18 |
| 5,343,179 | A | | 8/1994 | Pipich et al. | 335/167 |
| 5,448,442 | A | * | 9/1995 | Farag | 361/24 |
| 5,510,773 | A | | 4/1996 | Rodgers | 340/638 |

(Continued)

FOREIGN PATENT DOCUMENTS

EP 0 303 994 A 2/1989

(Continued)

OTHER PUBLICATIONS

Translation of EP 0 580 473 B1.*

(Continued)

*Primary Examiner* — Elvin G Enad
*Assistant Examiner* — Tsz Chan

(57) ABSTRACT

In a circuit breaker, a current transformer for fault powering trip unit electronics and sensing low currents and high currents includes a core with solid laminations and gapped laminations to sense a wide range of currents from locked-rotor currents to high, instantaneous short-circuit currents in a single current transformer. The current transformer can also fault power trip unit electronics without requiring an additional current transformer. The operating range of the circuit breaker is significantly enhanced compared to existing breakers that can sense only a limited range of current levels.

22 Claims, 6 Drawing Sheets

U.S. PATENT DOCUMENTS

| | | | | |
|---|---|---|---|---|
| 5,617,281 | A * | 4/1997 | Bauer et al. | 361/27 |
| 5,646,586 | A | 7/1997 | Castonguay et al. | 335/132 |
| 5,660,749 | A * | 8/1997 | Taguchi et al. | 219/130.1 |
| 5,666,256 | A | 9/1997 | Zavis et al. | 361/115 |
| 5,670,923 | A | 9/1997 | Gonzalez et al. | 335/177 |
| 5,701,111 | A | 12/1997 | Castonguay et al. | 335/177 |
| 5,710,399 | A | 1/1998 | Castonguay et al. | 200/17 R |
| 5,774,319 | A * | 6/1998 | Carter et al. | 361/93.4 |
| 6,009,615 | A | 1/2000 | McKean et al. | 29/602.1 |
| 6,031,195 | A | 2/2000 | Meili et al. | 200/318 |
| 6,061,217 | A | 5/2000 | Grunert et al. | 361/42 |
| 6,084,756 | A | 7/2000 | Doring et al. | 361/45 |
| 6,154,115 | A | 11/2000 | Flohr | 337/13 |
| 6,351,232 | B1 | 2/2002 | Marie | 341/155 |
| 6,459,349 | B1 * | 10/2002 | Giday et al. | 336/178 |
| 6,469,882 | B1 * | 10/2002 | Tignor | 361/93.1 |
| 6,591,482 | B1 * | 7/2003 | Fleege et al. | 29/605 |
| 6,717,076 | B2 * | 4/2004 | Narusevicius et al. | 200/50.24 |
| 6,954,060 | B1 * | 10/2005 | Edel | 324/117 R |
| 7,307,504 | B1 | 12/2007 | Carlino et al. | 336/213 |
| 2001/0032685 | A1 * | 10/2001 | Nakajima et al. | 148/306 |
| 2002/0145416 | A1 * | 10/2002 | Attarian et al. | 324/127 |
| 2003/0223171 | A1 * | 12/2003 | Benmouyal et al. | 361/100 |

FOREIGN PATENT DOCUMENTS

| | | | |
|---|---|---|---|
| EP | 0 477 936 | A | 4/1992 |
| EP | 0 580 473 | A | 1/1994 |
| GB | 397 635 | A | 8/1933 |
| GB | 1 293 134 | A | 10/1972 |
| GB | 2 360 135 | A | 9/2001 |
| WO | WO 2006/087342 | A1 | 8/2006 |

OTHER PUBLICATIONS

Written Opinion corresponding to co-pending International Patent Application Serial No. PCT/US2007/015914, European Patent Office, dated Mar. 14, 2008, 8 pages.

International Search Report corresponding to co-pending International Patent Application Serial No. PCT/US2007/015914, European Patent Office, dated Mar. 14, 2008, 8 pages.

* cited by examiner 500
510
524
522
514
512

620
644
514
516
660
630
734
632
636
650
642
620
518
512

734

CIRCUIT BREAKER-LIKE APPARATUS WITH COMBINATION CURRENT TRANSFORMER

CROSS-REFERENCE TO RELATED APPLICATION

This application claims the benefit of U.S. Provisional Application No. 60/831,006, filed Jul. 14, 2006, entitled "Motor Circuit Protector," which is hereby incorporated by reference in its entirety.

FIELD OF THE INVENTION

This invention relates to current transformer devices used for circuit breakers, motor control units, or the like, and more particularly, to current transformers for powering and sensing current over broad current ranges.

BACKGROUND OF THE INVENTION

As is well known, a circuit breaker is an automatically operated electro-mechanical device designed to protect a load from damage caused by an overload or a short circuit. A circuit breaker may be tripped by an overload or short circuit, which causes an interruption of power to the load. A circuit breaker can be reset (either manually or automatically) to resume current flow to the load. One application of circuit breakers is to protect motors as part of a motor control center ("MCC"). A typical MCC includes a temperature triggered overload relay, a contactor and a motor circuit protector ("MCP"). The MCP is a specialized circuit breaker that provides instantaneous protection against instantaneous short-circuit events. In the United States, these motor circuit protector devices must meet National Electric Code ("NEC") requirements when installed as part of a UL-listed MCC to provide instantaneous short-circuit protection.

Mechanical circuit breakers energize an electromagnetic device such as a solenoid to trip instantaneously in response to a rapid surge in current such as a short circuit. Most existing MCPs protect only a limited range of motors, but should avoid tripping in response to in-rush motor currents that occur during motor start-up. MCPs that sense relatively low currents may not be suitable for motors having a relatively low in-rush current because tripping will occur during normal operation of the motor. On the other hand, MCPs that sense relatively high currents may not trip on relatively low current levels such as those corresponding to locked-rotor current levels. Because of their limited operating range, some existing MCPs cannot protect for both relatively low current levels and relatively high current levels. Other existing MCPs that can protect against a wider range of fault currents are very large and their current transformers require large volumes of steel to remain in their linear range of operation.

Some circuit breakers include a current transformer, along with other electrical components, to make up the breaker system. Presently, current transformers used in existing circuit breaker devices are designed to supply power to trip unit electronics, or to sense low current ranges, or to sense high current ranges, and have a limited operating range. Thus, current transformer devices designed to sense low fault currents cannot effectively sense high fault currents. An additional current transformer specifically designed for supplying power to the trip unit electronics must be incorporated into the circuit breaker, increasing its size, complexity, and cost. Similarly, current transformer devices designed to sense high fault currents cannot effectively sense low fault currents.

What is needed is a current transformer system for use in circuit breaker devices that operates over wide current ranges.

SUMMARY OF THE INVENTION

Briefly, according to an embodiment of the present invention, a current transformer that extends the range of a circuit breaker, such as a motor circuit protector, includes both solid and gapped laminations that are staked and stacked together to form a single core. The solid laminations produce secondary current sufficient to power electronic components of the circuit breaker and sense relatively low currents. The gapped laminations produce secondary current sufficient to power the electronic components and sense relatively high currents, thereby extending the range of sensed currents for the MCP. The gapped laminations decrease the amount of remnant flux or saturation in the current transformer compared to solid cores.

The number of solid laminations and gapped laminations as well as the size of the gap in the gapped laminations are selected to fault power the MCP electronic components and sense a range of currents corresponding to locked-rotor or in-rush motor currents as well as high instantaneous short-circuit currents. As the number of solid laminations are increased, the saturation knee threshold region of the core's transfer function is pushed higher, resulting in saturation at a higher peak current. Gapped laminations are added for higher current sensing based on remnant flux requirements. As each gapped lamination is added, the core's saturation region shifts to a higher peak current value. By adjusting the ratio of solid-to-gapped laminations, a variety of operating ranges can be achieved for the MCP, operating ranges that can be significantly extended compared to existing MCPs. Moreover, the linear region of the current transformer can be extended by increasing the ratio of solid-to-gapped laminations and/or by varying the number of turns wound on the primary coil of the current transformer, resulting in more accurate approximation of the primary current. In a specific implementation, the core includes sixteen solid laminations and eight gapped laminations, resulting in a current transformer that can sense locked-rotor currents in the range of 10 A as well as high fault currents in the range of 3000 A.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
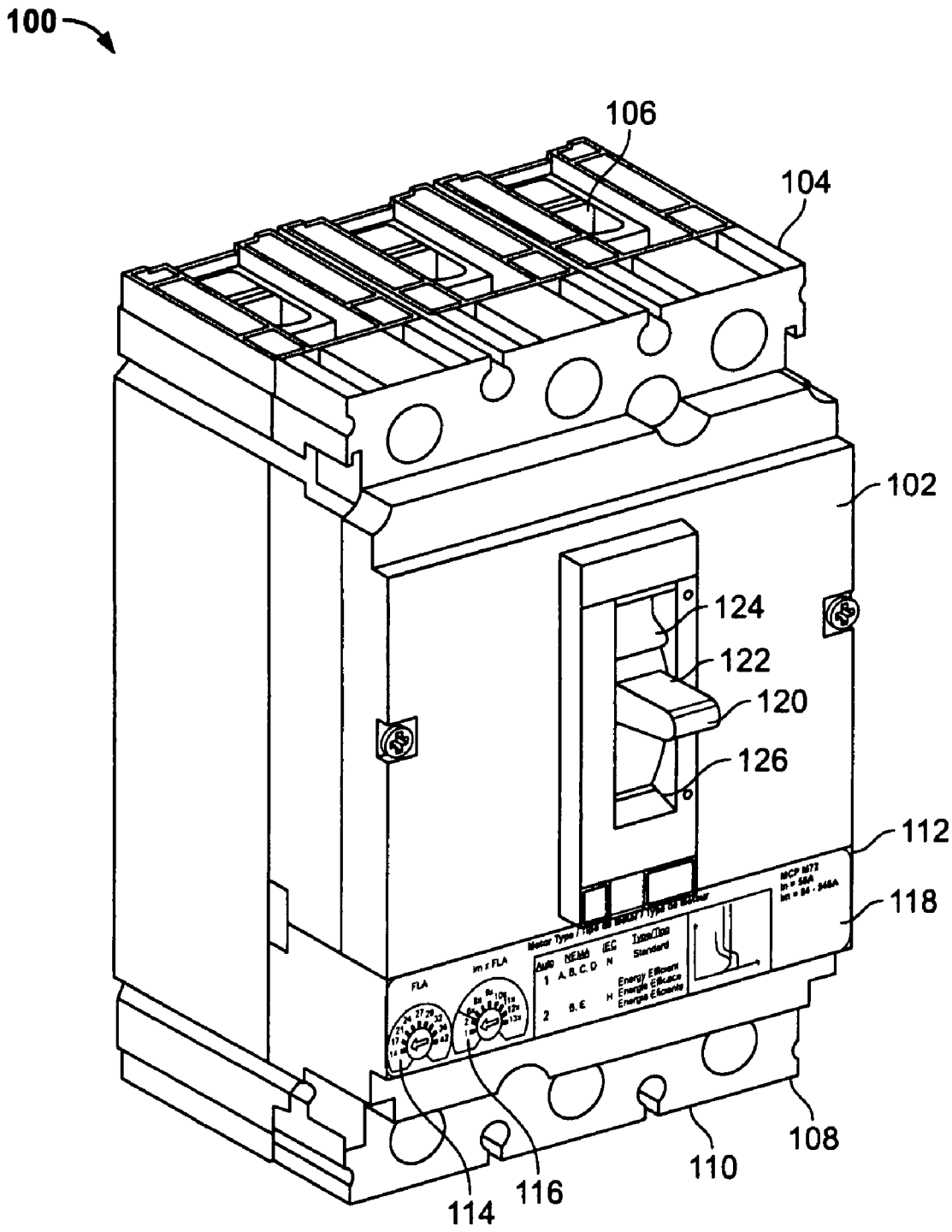
FIG. 1 is perspective view of a motor circuit protector according to certain embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Turning now to FIG. 1, an electronic motor circuit protector 100 is shown. The motor circuit protector 100 includes a durable housing 102 including a line end 104 having line terminals 106 and a load end 108 having load lugs or terminals 110. The line terminals 106 allow the motor circuit protector 100 to be coupled to a power source and the load terminals 110 allow the motor circuit protector 100 to be coupled to an electrical load such as a motor as part of a motor control center ("MCC"). In this example the motor circuit protector 100 includes a three-phase circuit breaker with three poles, although the concepts described below may be used with circuit protectors with different numbers of poles, including a single pole.

The motor circuit protector 100 includes a control panel 112 with a full load ampere ("FLA") dial 114 and an instantaneous trip point ("$I_m$") dial 116 which allows the user to configure the motor circuit protector 100 for a particular type of motor to be protected with the rated current range of the motor circuit protector 100. The full load ampere dial 114 allows a user to adjust the full load which may be protected by the motor circuit protector 100. The instantaneous trip point dial 116 has settings for automatic protection (three levels in this example) and for traditional motor protection of a trip point from 8 to 13 times the selected full load amperes on the full load ampere dial 114. The dials 114 and 116 are located next to an instruction graphic 118 giving guidance to a user on the proper settings for the dials 114 and 116. In this example, the instruction graphic 118 relates to NEC recommended settings for the dials 114 and 116 for a range of standard motors. The motor circuit protector 100 includes a breaker handle 120 that is moveable between a TRIPPED position 122 (shown in FIG. 1), an ON position 124 and an OFF position 126. The position of the breaker handle 120 indicates the status of the motor circuit protector 100. For example, in order for the motor circuit protector 100 to allow power to flow to the load, the breaker handle 120 must be in the ON position 124 allowing power to flow through the motor circuit protector 100. If the circuit breaker is tripped, the breaker handle 120 is moved to the TRIPPED position 122 by a disconnect mechanism, causing an interruption of power and disconnection of downstream equipment. In order to activate the motor circuit protector 100 to provide power to downstream equipment or to reset the motor circuit protector 100 after tripping the trip mechanism, the breaker handle 120 must be moved manually from the TRIPPED position 120 to the OFF position 126 and then to the ON position 124.

Figure 2:
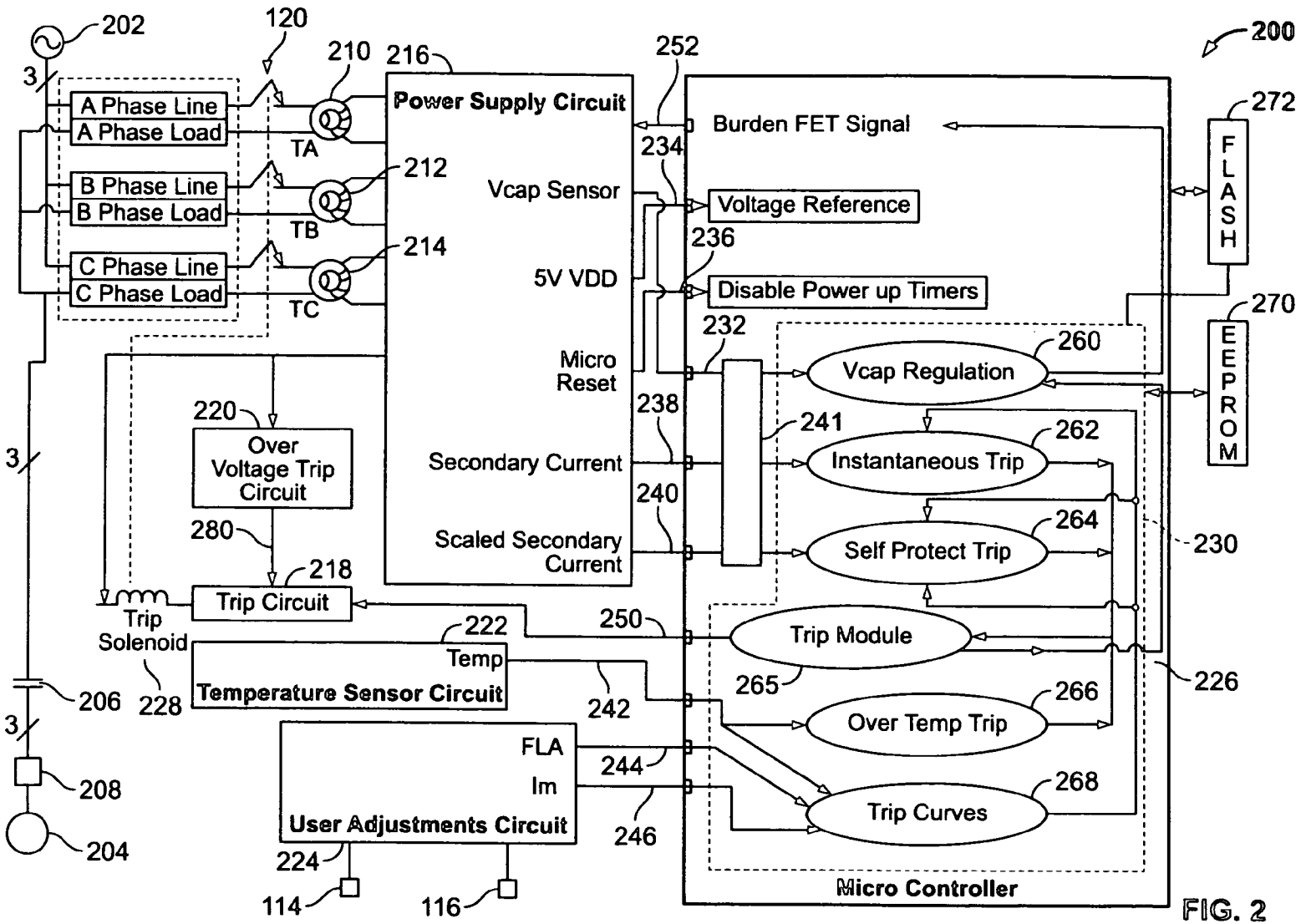
FIG. 2 is a functional block diagram of the motor circuit protector in FIG. 1 according to certain embodiments of the present disclosure.

FIG. 2 is a functional block diagram of the motor circuit protector 100 in FIG. 1 as part of a typical MCC configuration 200 coupled between a power source 202 and an electrical load such as a motor 204. The MCC configuration 200 also includes a contactor 206 and an overload relay 208 downstream from the power source 202. Other components such as a variable speed drive, start/stop switches, fuses, indicators and control equipment may reside either inside the MCC configuration 200 or outside the MCC configuration 200 between the power source 202 and the motor 204. The motor circuit protector 100 protects the motor 204 from a short circuit condition by actuating the trip mechanism, which causes the breaker handle 120 to move to the TRIPPED position when instantaneous short-circuit conditions are detected. The power source 202 in this example is connected to the three line terminals 106, which are respectively coupled to the primary windings of three current transformers 210, 212 and 214. Each of the current transformers 210, 212 and 214 has a phase line input and a phase load output on the primary winding. The current transformers 210, 212 and 214 correspond to phases A, B and C from the power source 202. The current transformers 210, 212 and 214 in this example are iron-core transformers and function to sense a wide range of currents. The motor circuit protector 100 provides instantaneous short-circuit protection for the motor 204.

The motor circuit protector 100 includes a power supply circuit 216, a trip circuit 218, an over-voltage trip circuit 220, a temperature sensor circuit 222, a user adjustments circuit 224, and a microcontroller 226. In this example, the microcontroller 226 is a PIC16F684-E/ST programmable microcontroller, available from Microchip Technology, Inc. based in Chandler, Ariz., although any suitable programmable controller, microprocessor, processor, etc. may be used. The microcontroller 226 includes current measurement circuitry 241 that includes a comparator and an analog-to-digital converter. The trip circuit 218 sends a trip signal to an electromechanical trip solenoid 228, which actuates a trip mechanism, causing the breaker handle 120 in FIG. 1 to move from the ON position 124 to the TRIPPED position 122, thereby interrupting power flow to the motor 204. In this example, the electro-mechanical trip solenoid 228 is a magnetic latching solenoid that is actuated by either stored energy from a discharging capacitor in the power supply circuit 216 or directly from secondary current from the current transformers 210, 212 and 214.

The signals from the three current transformers 210, 212 and 214 are rectified by a conventional three-phase rectifier circuit (not shown in FIG. 2), which produces a peak secondary current with a nominally sinusoidal input. The peak secondary current either fault powers the circuits 216, 218, 220, 222, and 224 and the microcontroller 226, or is monitored to sense peak fault currents. The default operational mode for current sensing is interlocked with fault powering as will be explained below. A control algorithm 230 is responsible for, inter alia, charging or measuring the data via analog signals representing the stored energy voltage and peak current presented to configurable inputs on the microcontroller 226. The control algorithm 230 is stored in a memory that can be located in the microcontroller 226 or in a separate memory device 272, such as a flash memory. The control algorithm 230 includes machine instructions that are executed by the microcontroller 226. All software executed by the microcontroller 226 including the control algorithm 230 complies with the software safety standard set forth in UL-489 SE and can also be written to comply with IEC-61508. The software requirements comply with UL-1998. As will be explained below, the configurable inputs may be configured as analog-to-digital ("A/D") converter inputs for more accurate comparisons or as an input to an internal comparator in the current measurement circuitry 241 for faster comparisons. In this example, the A/D converter in the current measurement circuitry 241 has a resolution of 8/10 bits, but more accurate A/D converters may be used and may be separate and coupled to the microcontroller 226. The output of the temperature sensor circuit 222 may be presented to the A/D converter inputs of the microcontroller 226.

The configurable inputs of the microcontroller 226 include a power supply capacitor input 232, a reference voltage input 234, a reset input 236, a secondary current input 238, and a scaled secondary current input 240, all of which are coupled to the power supply circuit 216. The microcontroller 226 also includes a temperature input 242 coupled to the temperature sensor circuit 222, and a full load ampere input 244 and an instantaneous trip point input 246 coupled to the user adjustments circuit 224. The user adjustments circuit 224 receives inputs for a full load ampere setting from the full load ampere dial 114 and either a manual or automatic setting for the instantaneous trip point from the instantaneous trip point dial 116.

The microcontroller 226 also has a trip output 250 that is coupled to the trip circuit 218. The trip output 250 outputs a trip signal to cause the trip circuit 218 to actuate the trip solenoid 228 to trip the breaker handle 120 based on the conditions determined by the control algorithm 230. The microcontroller 226 also has a burden resistor control output 252 that is coupled to the power supply circuit 216 to activate current flow across a burden resistor (not shown in FIG. 2) and maintain regulated voltage from the power supply circuit 216 during normal operation.

The breaker handle 120 controls manual disconnect operations allowing a user to manually move the breaker handle 120 to the OFF position 126 (see FIG. 1). The trip circuit 218 can cause a trip to occur based on sensed short circuit conditions from either the microcontroller 226, the over-voltage trip circuit 220 or by installed accessory trip devices, if any. As explained above, the microcontroller 226 makes adjustment of short-circuit pickup levels and trip-curve characteristics according to user settings for motors with different current ratings. The current path from the secondary output of the current transformers 210, 212, 214 to the trip solenoid 228 has a self protection mechanism against high instantaneous fault currents, which actuates the breaker handle 120 at high current levels according to the control algorithm 230.

The over-voltage trip circuit 220 is coupled to the trip circuit 218 to detect an over-voltage condition from the power supply circuit 216 to cause the trip circuit 218 to trip the breaker handle 120 independently of a signal from the trip output 250 of the microcontroller 226. The temperature sensor circuit 222 is mounted on a circuit board proximate to a copper burden resistor (not shown in FIG. 2) together with other electronic components of the motor circuit protector 100. The temperature sensor circuit 222 and the burden resistor are located proximate each other to allow temperature coupling between the copper traces of the burden resistor and the temperature sensor. The temperature sensor circuit 222 is thermally coupled to the power supply circuit 216 to monitor the temperature of the burden resistor. The internal breaker temperature is influenced by factors such as the load current and the ambient temperatures of the motor circuit protector 100. The temperature sensor 222 provides temperature data to the microcontroller 226 to cause the trip circuit 218 to actuate the trip solenoid 228 if excessive heat is detected. The output of the temperature sensor circuit 222 is coupled to the microcontroller 226, which automatically compensates for operation temperature variances by automatically adjusting trip curves upwards or downwards.

The microcontroller 226 first operates the power supply circuit 216 in a startup mode when a reset input signal is received on the reset input 236. A charge mode provides voltage to be stored for actuating the trip solenoid 228. After a sufficient charge has been stored by the power supply circuit 216, the microcontroller 226 shifts to a normal operation mode and monitors the power supply circuit 216 to insure that sufficient energy exists to power the electro-mechanical trip solenoid 228 to actuate the breaker handle 120. During each of these modes, the microcontroller 226 and other components monitor for trip conditions.

The control algorithm 230 running on the microcontroller 226 includes a number of modules or subroutines, namely, a voltage regulation module 260, an instantaneous trip module 262, a self protection trip module 264, an over temperature trip module 266 and a trip curves module 268. The modules 260, 262, 264, 266 and 268 generally control the microcontroller 226 and other electronics of the motor circuit protector 100 to perform functions such as governing the startup power, establishing and monitoring the trip conditions for the motor circuit protector 100, and self protecting the motor circuit protector 100. A storage device 270, which in this example is an electrically erasable programmable read only memory (EEPROM), is coupled to the microcontroller 226 and stores data accessed by the control algorithm 230 such as trip curve data and calibration data as well as the control algorithm 230 itself. Alternately, instead of being coupled to the microcontroller 226, the EEPROM may be internal to the microcontroller 226.

Figure 3:
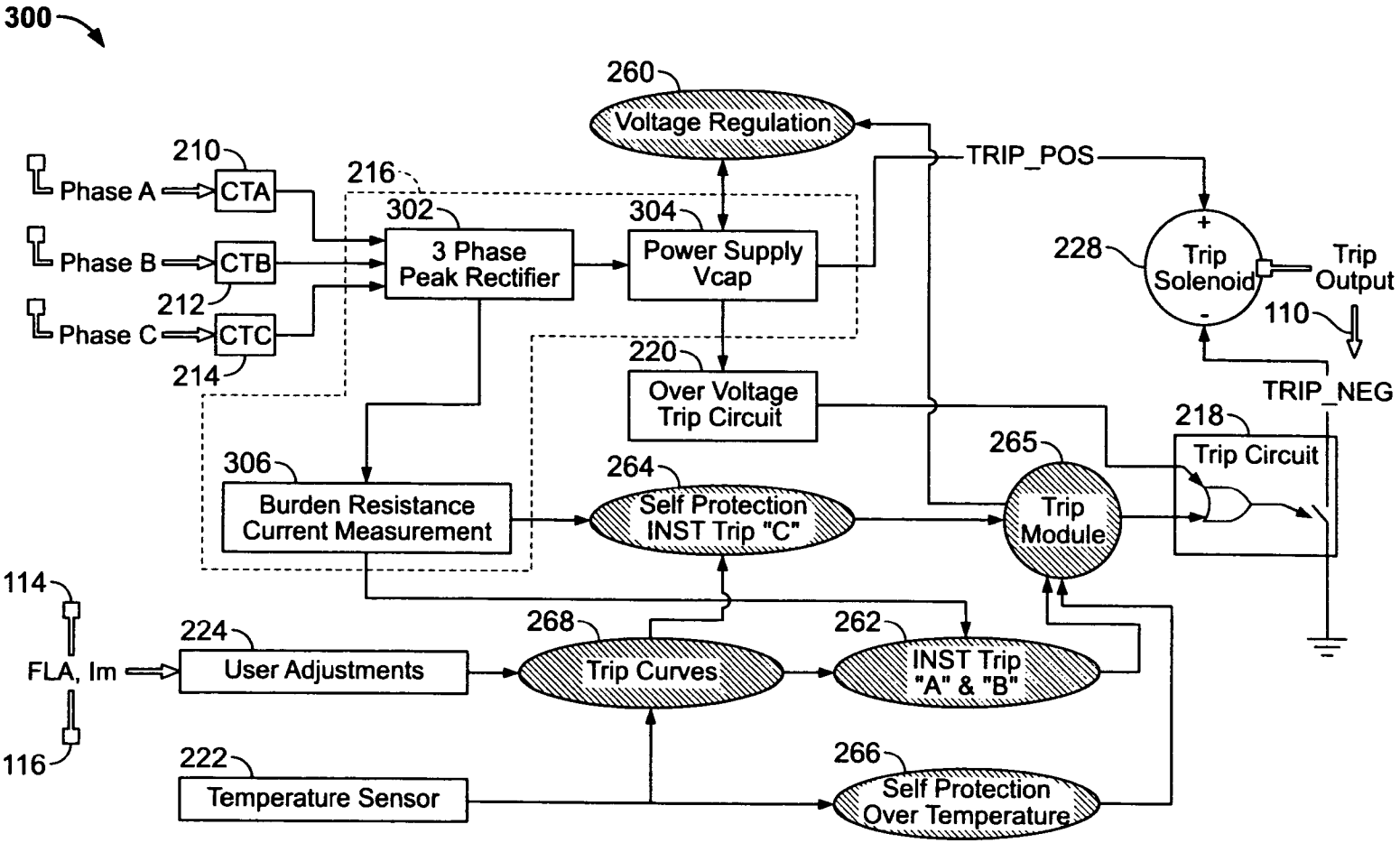
FIG. 3 is a functional block diagram of the operating components of a control algorithm of the motor circuit protector in FIG. 1 according to certain embodiments of the present disclosure.

FIG. 3 is a functional block diagram 300 of the interrelation between the hardware components shown in FIG. 2 and software/firmware modules 260, 262, 264, 266 and 268 of the control algorithm 230 run by the microcontroller 226. The secondary current signals from the current transformers 210, 212 and 214 are coupled to a three-phase rectifier 302 in the power supply circuit 216. The secondary current from the three-phase rectifier 302 charges a stored energy circuit 304 that supplies sufficient power to activate the trip solenoid 228 when the trip circuit 218 is activated. The voltage regulation module 260 ensures that the stored energy circuit 304 maintains sufficient power to activate the trip solenoid 228 in normal operation of the motor circuit protector 100.

The trip circuit 218 may be activated in a number of different ways. As explained above, the over-voltage trip circuit 220 may activate the trip circuit 218 independently of a signal from the trip output 250 of the microcontroller 226. The microcontroller 226 may also activate the trip circuit 218 via a signal from the trip output 250, which may be initiated by the instantaneous trip module 262, the self protection trip module 264, or the over temperature trip module 266. For example, the instantaneous trip module 262 of the control algorithm 230 sends a signal from the trip output 250 to cause the trip circuit 218 to activate the trip solenoid 228 when one of several regions of a trip curve are exceeded. For example, a first trip region A is set just above a current level corresponding to a motor locked rotor. A second trip region B is set just above a current level corresponding to an in-rush current of a motor. The temperature sensor circuit 222 outputs a signal indicative of the temperature, which is affected by load current and ambient temperature, to the over temperature trip module 266. The over temperature trip module 266 will trigger the trip circuit 218 if the sensed temperature exceeds a specific threshold. For example, load current generates heat internally by flowing through the current path components, including the burden resistor, and external heat is conducted from the breaker lug connections. A high fault current may cause the over temperature trip module 266 to output a trip signal 250 (FIG. 2) because the heat conducted by the fault current will cause the temperature sensor circuit 222 to output a high temperature. The over temperature trip module 266 protects the printed wire assembly from excessive temperature buildup that can damage the printed wire assembly and its components. Alternately, a loose lug connection may also cause the over temperature trip module 266 to output a trip signal 250 if sufficient ambient heat is sensed by the temperature sensor circuit 222.

The trip signal 250 is sent to the trip circuit 218 to actuate the solenoid 228 by the microcontroller 226. The trip circuit 218 may actuate the solenoid 228 via a signal from the over-voltage trip circuit 220. The requirements for "Voltage Regulation," ensure a minimum power supply voltage for "Stored Energy Tripping." The trip circuit 218 is operated by the microcontroller 226 either by a "Direct Drive" implementation during high instantaneous short circuits or by the control algorithm 230 first ensuring that a sufficient power supply voltage is present for the "Stored Energy Trip." In the case where the "Stored Energy" power supply voltage has been developed, sending a trip signal 250 to the trip circuit 218 will ensure trip activation. During startup, the power supply 216 may not reach full trip voltage, so a "Direct Drive" trip operation is required to activate the trip solenoid 228. The control for Direct Drive tripping requires a software comparator output sense mode of operation. When the comparator trip threshold has been detected, the power supply charging current is applied to directly trip the trip solenoid 228, rather than waiting for full power supply voltage.

The over-voltage trip circuit 220 can act as a backup trip when the system 200 is in "Charge Mode." The control algorithm 230 must ensure "Voltage Regulation," so that the over-voltage trip circuit 220 is not inadvertently activated. The default configuration state of the microcontroller 226 is to charge the power supply 216. In microcontroller control fault scenarios where the power supply voltage exceeds the over voltage trip threshold, the trip circuit 218 will be activated. Backup Trip Levels and trip times are set by the hardware design.

The user adjustments circuit 224 accepts inputs from the user adjustment dials 114 and 116 to adjust the motor circuit protector 100 for different rated motors and instantaneous trip levels. The dial settings are converted by a potentiometer to distinct voltages, which are read by the trip curves module 268 along with temperature data from the temperature sensor circuit 222. The trip curves module 268 adjusts the trip curves that determine the thresholds to trigger the trip circuit 218. A burden circuit 306 in the power supply circuit 216 allows measurement of the secondary current signal, which is read by the instantaneous trip module 262 from the peak secondary current analog-to-digital input 238 (shown in FIG. 2) along with the trip curve data from the trip curves module 268. The self-protection trip module 264 also receives a scaled current (scaled by a scale factor of the internal comparator in the current measurement circuitry 241) from the burden resistor in the burden circuit 306 to determine whether the trip circuit 218 should be tripped for self protection of the motor circuit protector 100. In this example, fault conditions falling within this region of the trip curve are referred to herein as falling within region C of the trip curve.

As shown in FIGS. 2 and 3, a trip module 265 is coupled between the trip circuit 218 and the voltage regulation module 260. Trip signals from the instantaneous trip module 262, the self protection trip module 264, and the over temperature trip module 266 are received by the trip module 265.

The following terms may be used herein:

DIRECT DRIVE—Initiating a trip sequence prior to achieving a stored energy trip voltage.

STORED ENERGY TRIP—Sending a trip sequence with knowledge of the stored energy trip voltage on the power supply voltage, $V_{CAP}$, 304.

REDUNDANT TRIP OUTPUT—Send both "trip output" to the trip circuit 218 and "FET off" output to the power supply circuit 216 if the digital trip output was not successful. This will eventually cause the over-voltage circuit 220 to activate the trip solenoid 228.

OVER-VOLTAGE TRIP BACKUP—A trip sequence that uses the over-voltage trip circuit 220 to trip the breaker. This sequence is a backup for the normal "trip circuit" method. This sequence can be activated later in time due to a higher $V_{CAP}$ 304 activation voltage.

Figure 4:
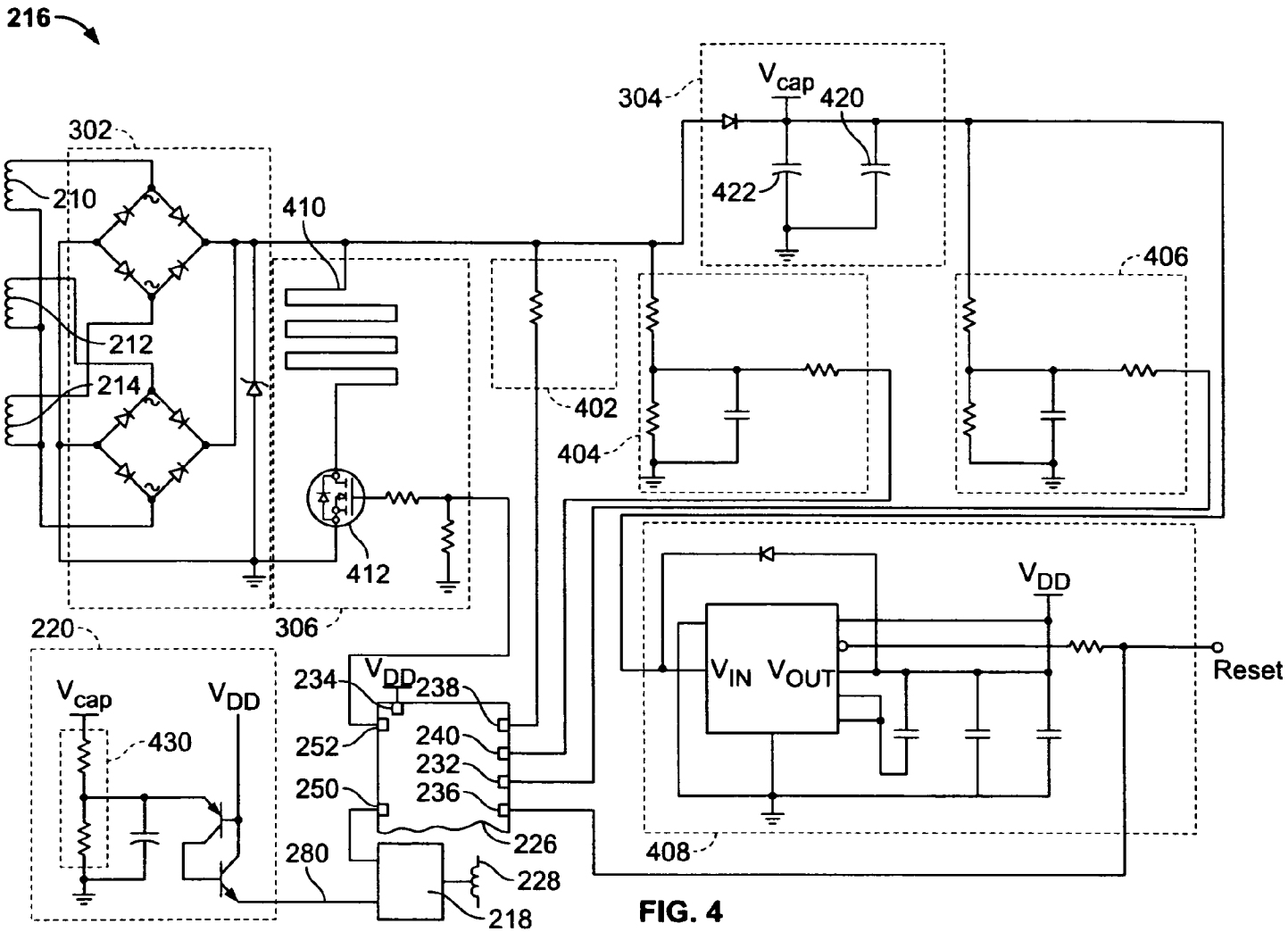
FIG. 4 is a circuit diagram of the stored energy circuit of the motor circuit protector in FIG. 1 according to certain embodiments of the present disclosure.

FIG. 4 is a detailed circuit diagram of various circuits of the motor circuit protector 100, including the power supply circuit 216 and other related components including the stored energy circuit 304, the burden circuit 306, a scaled current comparator current input 404, an energy storage capacitor voltage input circuit 406, and a voltage regulator circuit 408. The power supply circuit 216 derives the secondary current from the secondary windings of the three current transformers 210, 212 and 214, which are rectified by the three-phase rectifier 302. The output of the three-phrase rectifier 302 is coupled to the burden circuit 306, which is coupled in parallel to the stored energy circuit 304. The power supply circuit 216 also includes a peak current input circuit 402 that is provided to the microcontroller 226, a scaled current comparator input circuit 404 that is provided to the comparator of the current measurement circuitry 241 of the microcontroller 226 via the scaled secondary current input 240, a stored energy capacitor voltage input circuit 406 and a voltage regulator circuit 408. The stored energy capacitor input 232 of the microcontroller 226 is coupled to the stored energy capacitor input circuit 406, the reference voltage input 234 is coupled to the voltage regulator circuit 408, the secondary current input 238 is coupled to the peak current input circuit 402, and the scaled secondary current input 240 is coupled to the scaled current comparator input circuit 404.

The burden circuit 306 includes a burden resistor 410 connected in series with a burden resistor control field effect transistor (FET) 412. The gate of the burden resistor control FET 412 is coupled to the burden resistor control output 252 of the microcontroller 226. Turning on the burden resistor control FET 412 creates a voltage drop across the burden resistor 410 and the burden resistor control FET 412 allowing measurement of the secondary current for fault detection purposes. The voltage drop may also provide an indication of current available to charge the stored energy circuit 304.

The secondary current from the rectifier 302 is measured by the peak current input circuit 402 and the scaled current comparator input circuit 404. The stored energy circuit 304 includes two energy storage capacitors 420 and 422. The energy storage capacitors 420 and 422 are charged by the secondary current when the burden resistor control FET 412 is switched off and are discharged by the trip circuit 218 to actuate the trip solenoid 228 in FIG. 2.

The scaled current comparator input circuit 404 has an input that is coupled to the rectifier 302. The scaled current comparator input circuit 404 includes a voltage divider to scale down the signal from the rectifier 302 and is coupled to the scaled secondary current input 240 of the microcontroller 226. The voltage regulator circuit 408 provides a component power supply (in this example, 5 volts nominal) to the electronic components such as the microcontroller 226 in the motor circuit protector 100. The microcontroller 226 includes an internal comparator in the current measurement circuitry 241 that may be switched to compare the input 232 or the input 240 with a reference voltage that is received from the voltage regulator circuit 408 to the reference voltage input 234. The reference voltage is also a reference voltage level when the inputs 232 and 240 are configured to be coupled to analog-to-digital converters. When the internal comparator is switched to receive the input 240 to the self protection trip module 264, the peak current is scaled for the comparator input by external hardware such as the scaled current comparator input circuit 404. An internal comparator reference is set by the microcontroller 226 to control the comparator trip thresholds.

The stored energy capacitor voltage input circuit 406 includes the parallel-connected capacitors 420 and 422 and measures the voltage level of the stored energy circuit 304, which is indicative of the stored energy in the capacitors 420 and 422. The stored energy capacitor voltage input circuit 406 provides a signal indicative of the voltage on the capacitors 420 and 422 to the stored energy capacitor input 232 of the microcontroller 226 to monitor the voltage of the stored energy circuit 304.

Upon startup of the motor circuit protector 100 (such as when the user throws the breaker handle 120 to the ON position), the voltage regulator circuit 408 and the microcontroller 226 receive a reset signal from the power supply circuit 216 and the rectifier 302 begins to charge the capacitors 420 and 422. A start-up delay time including a hardware time delay and a fixed software time delay elapses. The hardware time delay is dependent on the time it takes the secondary current to charge the stored energy circuit 304 to a voltage sufficient to operate the voltage regulator circuit 408. In this example, the voltage regulator circuit 408 needs a minimum of 5 volts (nominal) to operate. The fixed software time delay is the time required for stabilization of the regulated component voltage from the voltage regulator circuit 408 to drive the electronic components of the motor circuit protector 100. The software delay time is regulated by an internal timer on the microcontroller 226. The overall start-up delay time typically covers the first half-cycle of the current.

After the start-up delay time, the microcontroller 226 executes the control algorithm 230, which is optionally stored in the internal memory of the microcontroller 226, and enters a "Self Protection" measurement mode, which relies upon the internal comparator of the microcontroller 226 for rapid detection of fault currents. The microcontroller 226 turns on the burden resistor control FET 412 allowing measurement of the secondary current. The burden resistor control FET 412 is turned on for a fixed period of time regulated by the internal timer on the microcontroller 226. The voltage regulation module 260 configures the microcontroller 226 to couple the scaled secondary current input 240 to an input to the internal comparator of the microcontroller 226. The scaled secondary current input 240 reads the signal from the scaled peak current input circuit 404, which measures the secondary current from the rectifier 302 and requires minimal initializing overhead. The peak current from the secondary current is predicted via the secondary current detected by the scaled current comparator input circuit 404.

The internal comparator in the microcontroller 226 is a relatively fast device (compared to, for example, an A/D converter, which may be more accurate but operates more slowly) and thus can detect fault currents quickly while in this mode. If the peak current exceeds a threshold level, indicating a fault current, the burden resistor control FET 412 is turned off by a signal from the burden resistor control output 252 of the microcontroller 226. The threshold level is set depending on the desired self-protection model of the range of currents protected by the particular type of motor circuit protector 100. The disconnection of the FET 412 causes the fault current to rapidly charge the capacitors 420 and 422 of the stored energy circuit 304 and actuate the trip solenoid 228 to trip the trip mechanism of the motor circuit protector 100, which is visually indicated by the breaker handle 120.

After the initial measurement is taken, the control algorithm 230 enters into a charge only mode of operation in order to charge the capacitors 420 and 422 of the stored energy circuit 304. The control algorithm 230 sends a signal to turn off the burden resistor control FET 412, causing the capacitors 420 and 422 to be charged. The control algorithm 230 remains in the charge only mode until sufficient energy is stored in the stored energy circuit 304 to actuate the trip solenoid 228 in the event of a detected fault condition. In the charge only mode, the voltage regulation module 260 configures the microcontroller 226 to take a voltage input from the peak current input circuit 402 to the secondary current input 238 which is configured for an analog to digital converter. The signal from the secondary current input 238 analog to digital conversion is more accurate then the internal comparator but relatively slower. During the charge only mode, if a fault current occurs, the stored energy circuit 304 is charged quickly and the fault current actuates the trip solenoid 228 therefore providing self protection.

It should be noted that the control algorithm 230 can be programmed to multiplex current measurement for self-protection sensing and power-supply charging for minimum stored-energy tripping.

The voltage regulation module 260 also configures the internal comparator in the current measurement circuitry 241 to be connected to the stored energy capacitor voltage input circuit 406 via the capacitor voltage input 232 to detect voltage levels from the stored energy circuit 304. The voltage regulation module 260 thus maintains real time monitoring over the regulated voltage output from the stored energy circuit 304 while performing other software tasks such as monitoring fault currents.

During the charge only mode, the control algorithm 230 charges the stored energy circuit 304 from the minimum voltage regulation level (5 volts in this example from the hardware startup period) to a voltage level (15 volts in this example) indicative of sufficient energy to actuate the trip solenoid 228. The charging of the capacitors 420 and 422 is regulated by the voltage regulation module 260, which keeps the burden resistor control FET 412 off via the burden resistor control output 252 causing the capacitors 420 and 422 to charge. The voltage regulation module 260 holds the stored energy circuit 304 in the charge mode until a start voltage threshold level (15 volts in this example) is reached for the supply voltage from the stored energy circuit 304 and is thus sensed through the stored energy capacitor voltage input circuit 406. The timing of when the start voltage threshold level is reached depends on the secondary current from the rectifier 302 to the stored energy circuit 304. The ability of the voltage regulation module 260 to hold the charge mode allows designers to avoid external stability hardware components. This process reduces peak overshoot during high instantaneous startup scenarios while charging the capacitors 420 and 422 to the start voltage threshold level more efficiently.

Once the minimum energy for actuating the trip solenoid 228 is stored, the control algorithm 230 proceeds to a steady state or run mode. In the run mode, the control algorithm 230 maintains control of the voltage from the stored energy circuit 304 with the voltage regulation module 260 after the sufficient energy has been stored for tripping purposes. The voltage regulation module 260 maintains a voltage above the stored energy trip voltage by monitoring the voltage from the stored energy circuit 304 from the stored energy capacitor voltage input circuit 406 to the stored energy capacitor input 232. The stored energy capacitor input 232 is internally configured as an A/D converter input for more accurate voltage level sensing for the run mode.

The voltage regulation module 260 also regulates the stored energy circuit 304 and avoids unintended activation of the over-voltage trip circuit 220. The power supply regulation task is serviced in the run mode on a periodic basis to maintain the necessary energy in the stored energy circuit 304. The regulation task may be pre-empted to service higher priority tasks such as the trip modules 262 and 264. In the run mode, the voltage regulation module 260 monitors the voltage from the stored energy circuit 304. The voltage regulation module 260 maintains the voltage output from the stored energy circuit 304 above the backup trip set points, which include a high set point voltage and a low set point voltage. If the energy falls below a high set point voltage threshold (14.7 volts in this example), the voltage regulation module 260 initiates fixed width charge pulses, by sending control signals via the burden resistor control output 252 to the burden resistor control FET 412 to turn on and off until a high voltage set point for the power supply voltage is reached. The width of the pulse corresponds with the maximum allowable voltage ripple at the maximum charge rate of the stored energy circuit 304. The number of fixed width charge pulses is dependent on the voltage level from the stored energy circuit 304. If the energy is above the high set point voltage, the voltage regulation module 260 will not initiate fixed width charge pulse in order to avoid unintended activation of the over-voltage trip circuit 220.

If the voltage signals detected from the stored energy capacitor voltage input circuit 406 are such that the microcontroller 226 cannot maintain regulation voltage on the stored energy circuit 304, a threshold voltage low set point (13.5 volts in this example) for the stored energy circuit 304 is reached and the control algorithm 230 will charge the stored energy circuit 304 to reach a minimum voltage necessary for trip activation of the trip solenoid 228. The microcontroller 226 will restart the charge mode to recharge the capacitors 420 and 422 in the stored energy circuit 304. During the charging process, fault current measurement is disabled, however if a fault current of significant magnitude occurs, the fault current will rapidly charge the capacitors 420 and 422 of the measured stored energy circuit 304 and thus overall trip performance is not affected. The application will also restart when the watchdog timer in the microcontroller 226 resets.

In the run mode, the microcontroller 226 is in measurement mode by keeping the burden resistor control FET 412 on. The microcontroller 226 monitors the secondary current via the secondary current input 238, which is configured as an analog-to-digital converter for more accurate measurements. The instantaneous trip module 262 sends an interrupt signal from the trip output 250 of the microcontroller 226 to cause the trip circuit 218 to activate the trip solenoid 228 for conditions such as a motor in-rush current or a locked motor rotor (trip conditions A and B), which cause a trip curve to be exceeded based on the secondary current. The internal comparator of the microcontroller 226 is configured to accept an input from the scaled secondary current input 240, which is read by the self protection trip module 264 to determine whether the trip circuit 218 should be tripped for self protection of the motor circuit protector 100 in the case of high instantaneous current (trip condition C) detected from the faster measurement of the comparator. As explained above, the trip conditions for self protection are a function of the user settings from the dials 114 and 116.

In case of a failure of the microcontroller 226 to send the appropriate trip signal 250, the solenoid 228 is triggered by the over voltage trip circuit 220 (shown schematically in FIG. 4). The over voltage trip circuit 220 includes a voltage divider 430, which steps down the voltage level. In this example, pull up transistors cause the over voltage trip circuit 220 to send a discrete trip signal 280 to the trip circuit 218, causing the trip circuit 218 to actuate the trip solenoid 228 to trip the breaker handle 120.

Figures 5, 6, 7:
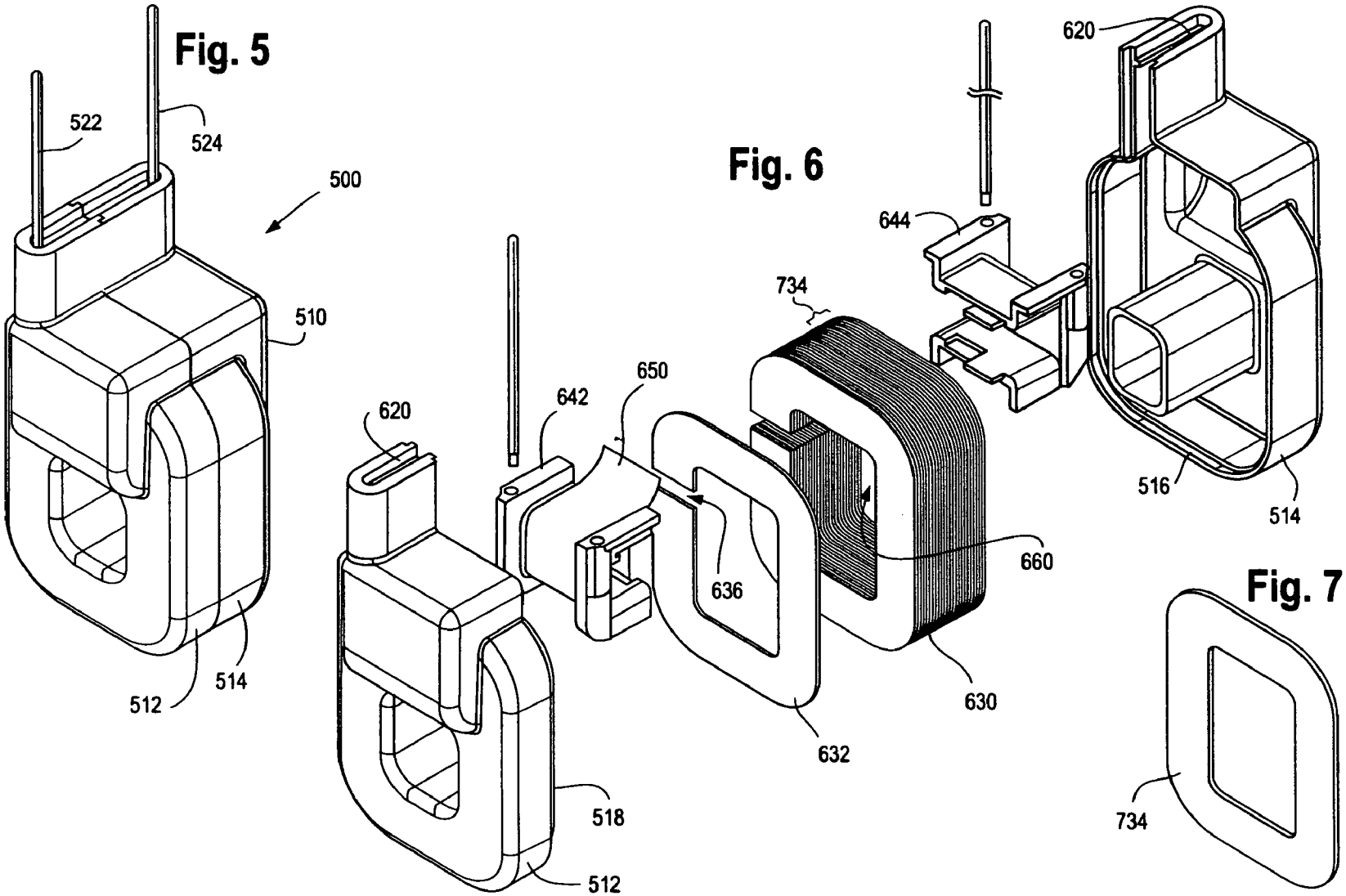
FIG. 5 is an isometric view of a current transformer according to certain embodiments of the present disclosure.
FIG. 6 is an exploded isometric view of the current transformer in FIG. 5 according to certain embodiments of the present disclosure.
FIG. 7 is an isometric view of a solid lamination from the current transformer shown in FIG. 6 according to certain embodiments of the present disclosure.

FIG. 5 is an isometric view of a current transformer ("CT") 500 according to certain embodiments of the present disclosure, and is suitable for use as the current transformers 210, 212, or 214 shown in FIG. 2. The current transformer 500 is enclosed within a housing 510. Though the housing can be configured in any of a number of ways, the housing 510 can, for example, comprise two housing elements 512, 514 formed to fit in manner that encloses the various current transformer components. In certain embodiments, the housing can be configured to partially enclose the current transformer components. A first lead pin 522 and a second lead pin 524 extend from the enclosed current transformer components through the housing 510. In certain embodiments, the lead pins 522, 524 from current transformer 500 are connected to power supply circuit 216 as illustrated, for example, in FIGS. 2-4. The housing can be constructed with nonconductive materials such as, for example, plastics or ceramics. The current transformer 500 is mounted to a printed wire board (PWB) (not shown).

FIG. 6 is an exploded isometric view of the current transformer 500 in FIG. 5 according to certain embodiments of the present disclosure. The current transformer 500 includes two housing elements 512, 514 that enclose a number of current transformer components. Housing element 514 is configured with a joint edge 516 that overlaps joint edge 518 of the housing element 512. The overlapping joint arrangement between housing elements 512, 514 allows for dielectric integrity between current transformer 500 and uninsulated current path sections of the current transformer 500 in contact with current transformer housing 510. Housing 510 can be configured to substantially enclose or to partially enclose the current transformer components 630, 632, 642, 644, 650. In the implementation illustrated in FIG. 6, the components 630, 632, 642, 644, 650 of the current transformer are substantially enclosed upon the joining of housing elements 512, 514 with the exception of a tunnel 620 through which first lead pin 522 and second lead pin 524 extend from the interior to the exterior of housing 510.

Current transformer 500 includes a core 630 that includes gapped laminations 632 and solid laminations 734 (an exemplary solid lamination 734 is shown in FIG. 7) combined together to form a single core element. The solid laminations 734 in the current transformer core 630 provide secondary current output sufficient to power the electronic components of the system 200 and further sense relatively low currents (for example, current in the range of 10 amperes). The gapped laminations 632 in current transformer core 630 decrease the amount of remnant flux or saturation in the current transformer 500, while providing secondary current sufficient to power the electronic components of the system 200 and sensing relatively high currents (for example, currents in the range of 3,000 amperes).

In other words, the combination of the solid and gapped laminations increases the range of primary currents that can be sensed by the current transformer 500 while also providing a sufficient amount of secondary current available for powering the electronic components of the system 200, including in particular the trip solenoid 228 and the power supply circuit 216. According to aspects of the present invention, it is not necessary to implement a transformer separate from the sensing transformer(s) for powering the power supply and other electronic components of the system 200. Both power supply and current sensing are accomplished in a single current transformer that also senses current over a very wide range of currents, e.g., motor locked-rotor ("LRA") currents (on the order of 10 A for a lower threshold) to motor in-rush currents to high instantaneous short-circuit currents (as high as 3000 A for an upper threshold for in-rush motor currents). Thus, the ratio of the upper current threshold to the lower current threshold exceeds 100:1 and can be as high as 300:1.

In certain embodiments, the gapped laminations 632 and the solid laminations 734 are combined in a single stacked core 630 having a central opening 660. Some benefits of a single stack core include that a higher lamination factor is achieved and post-annealing stresses are minimized in the current transformer core 630. Another benefit simplifies the manufacturing process, e.g., the gapped laminations 632 and the solid laminations 734 can be punched from the same die. A retractable insert can be used to punch out the gap 636 in the gapped lamination 632. Because both laminations are made from the same die, the consistency between individual laminations is increased. The current transformer 500 can be assembled efficiently with the single stacked core 630 according to aspects of the present invention.

The stacked gapped laminations and solid laminations are staked together to form the single stacked core 630. Bobbin halves 642, 644 circumscribe the core 630 when the two halves 642, 644 are joined together. In an implementation, the two bobbin halves 642, 644 are held together by a layer of tape 650 after the two bobbin halves are joined. Bobbin halves 642, 644 function as an insulator while holding the secondary windings in place. The number of gapped laminations 632 and solid laminations 734 in a current transformer core 630 can be adjusted depending upon the range of current values that need to be sensed by the motor circuit protector 100.

As a result of the increased current range sensing of the current transformer according to the present invention, lower motor locked-rotor current values are detected along with higher motor in-rush current values as well as high instantaneous short-circuit current values. For example, in certain embodiments, the ratio of gapped-to-solid laminations of the current transformer 500 can be adjusted to sense currents ranging from 9 amperes to 3,000 amperes or any ranges in between. The particular range may depend upon the particular locked-rotor or in-rush current specifications provided by the motor manufacturer.

Figure 8:
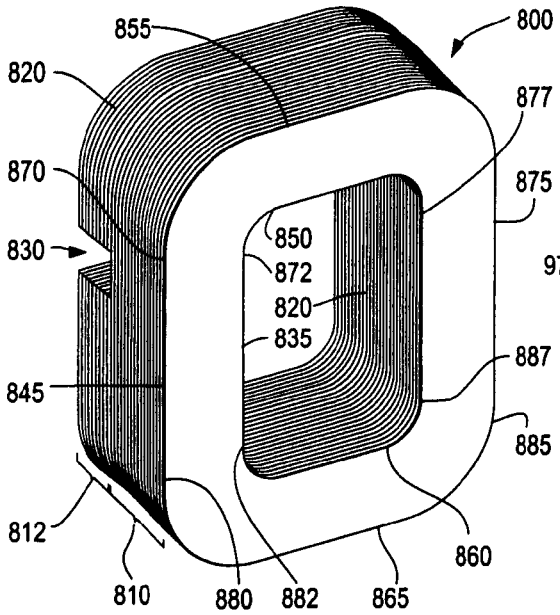
FIG. 8 is an isometric view of a current transformer core according to certain embodiments of the present disclosure.

FIG. 8 illustrates an isometric view of a current transformer core 800 according to certain embodiments of the present disclosure with a gapped-to-solid laminations ratio of approximately 1:3. In other implementations, the gapped-to-solid laminations ratio is 1:2. A current transformer, such as the one illustrated in FIG. 8 includes solid laminations 810 for relatively low current sensing, for example, in the range of 9 or 10 amperes, for current under locked-rotor conditions. The gapped laminations 812 can then be utilized to decrease the amount of remnant flux so that the electronic components of the system 200 will be able to receive power from the current transformers 210, 212, 214 and while also accurately sensing high instantaneous fault currents.

According to another implementation of the present invention, the core 800 can be constructed with twenty-four laminations comprising eight solid laminations 810 and sixteen gapped laminations 812. Alternately, the core 800 can be constructed with sixteen solid laminations and eight gapped laminations. The twenty-four laminations are stacked and staked together as shown for core 800 so that the lamination edges 820 are substantially aligned with each other. The core 800 is assembled with the gapped laminations 812 having a cumulative thickness ranging from 0.13 inches to 0.145 inches. The solid laminations 810 are stacked to the gapped laminations 812 to achieve a total core thickness ranging from 0.39 inches to 0.44 inches. The individual gapped laminations 812 and solid laminations 810 are approximately 0.016-0.019 inches thick at lamination edge 820. In certain embodiments, no lamination materials extend beyond the surface (the lamination edge 820) of the outermost and innermost laminations due to the staking process. The nominal solid lamination area is approximately 0.0607 $in^2$, and the nominal gapped lamination area is approximately 0.0304 $in^2$. The size of the gap in the gapped laminations is approximately 0.085 in.

Figure 9:
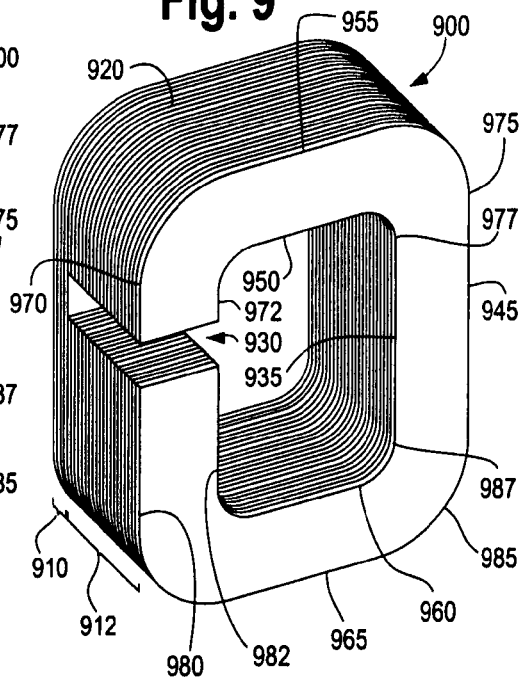
FIG. 9 is an isometric view of a current transformer core according to certain embodiments of the present disclosure.

FIG. 9 illustrates an isometric view of a current transformer core 900 according to certain embodiments of the present disclosure. The core 900 includes seven-eighths gapped laminations and one-eighth solid laminations, representing a gapped-to-solid laminations ratio of 7:1. In an example, the core 900 includes twenty-four laminations as illustrated with three solid laminations 910 and twenty-one gapped laminations 912. The twenty-four laminations are stacked and staked together as shown for the core 900 so that the lamination edges 920 are substantially aligned with each other. The core 900 has a total core thickness ranging from 0.39 inches to 0.44 inches. The individual solid laminations 910 and gapped laminations 912 are each approximately 0.016-0.019 inches thick at the lamination edge 920. In certain embodiments, no lamination materials extend beyond the surface (formed by the lamination edge 920) of the outermost and innermost laminations due to the staking process. The nominal solid lamination area is approximately 0.0114 $in^2$, and the nominal gapped lamination area is approximately 0.0797 $in^2$. The size of the gap in the gapped laminations is approximately 0.085 in.

The ratio of gapped laminations 632, 812, 912 to solid laminations 734, 810, 910 in the single stacked current transformer core 630,800, 900 can be determined by balancing output level and remnant flux parameters. The power-up output levels are adjusted by the number of solid laminations, and as the number of solid laminations increases, the linear portion of the current transformer's operating range is extended, pushing the knee threshold of the core's transfer function higher (i.e., the core's saturation region begins at higher peak currents). Then, gapped laminations are added for higher fault current detection based on the remnant flux requirements. As each gapped lamination is added, the core's saturation region shifts to a higher peak current value.

In some embodiments, the gapped laminations 812, 912 and the solid laminations 810, 910 in FIGS. 8 and 9 have similar dimensions. In an embodiment, the gap 830, 930 in gapped laminations 812, 912 is approximately 0.085 inches. The gap can comprise air. As previously stated, the thickness of the individual laminations can be around 0.016-0.019 inches each. The width of the individual laminations from the side inner edge 835, 935 to the side outer edge 845, 945 and the top inner edge 850, 950 to the top outer edge 855, 955 can be around 0.21-0.22 inches. The height of the lamination from the top outer edge 855, 955 to the bottom outer edge 865, 965 can be around 1.13-1.15 inches. The height of the space defined by the interior space of the laminations from top inner edge 855, 955 to the bottom inner edge 860, 960 can be around 0.70-0.72 inches. The width of the laminations can vary and the laminations can taper slightly from the upper portion to the lower portion of the laminations. For example, the lamination width from the left upper outer edge 870, 970 to the right upper outer edge 875, 975 can be around 0.90-0.94 inches. The lamination width from the left lower outer edge 880, 980 to the right lower outer edge 885, 985 can be around 0.86-0.90 inches. The lamination width for the interior space of the laminations can also vary and taper slightly from the upper portion to the lower portion. The lamination width from the left upper inner edge 872, 972 to the right upper inner edge 877, 977 can be around 0.47-0.51 inches. The lamination width from the left lower inner edge 882, 982 to the right lower inner edge 887, 987 can be around 0.44-0.48 inches.

Figure 10:
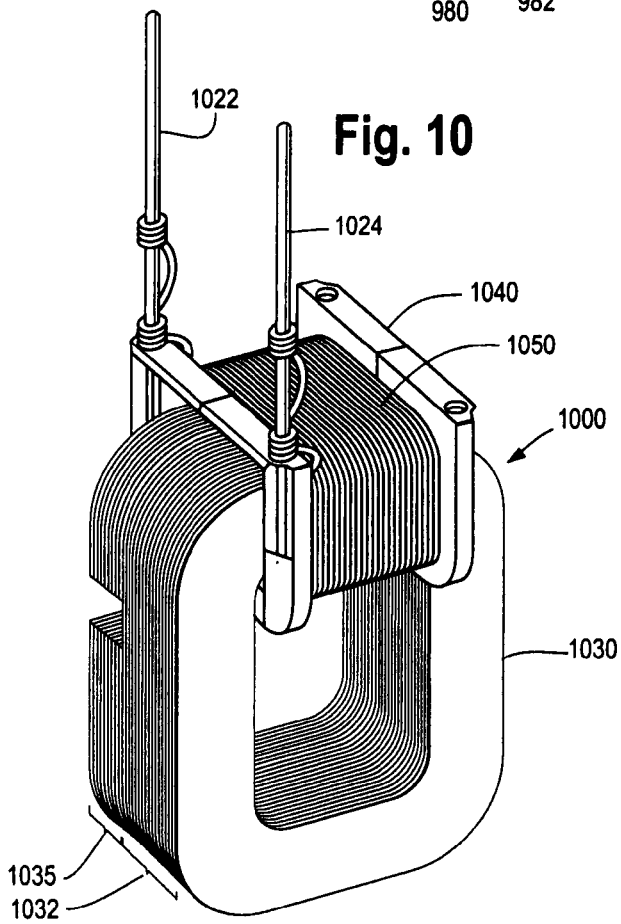
FIG. 10 is a perspective view of the interior of a current transformer according to certain embodiments of the present disclosure.

In the embodiments illustrated, for example, in FIGS. 9 and 10, the gapped laminations 812, 912 are generally shown as C-shaped or reverse C-shaped. Other embodiments of the present invention contemplate gapped laminations that are L-shaped or U-shaped, or variations thereof, where the gapped laminations are staked with some solid laminations at the front or back of the core. In certain other embodiments, the gapped laminations are partially gapped or notched instead of having a full gap.

Gapped laminations 812, 912 and solid laminations 810, 910 can be made of an iron alloy that, for example, comprises silicon, aluminum and iron, such as 26 gauge non-oriented Si-Al-Fe semi-processed cold rolled steel (ASTM 47S175). The laminations can further be heat treated for approximately one hour at a temperature of approximately 1,550° F. in a hydrogen/nitrogen atmosphere as set forth in the American Society of Testing Material (ASTM) Standard 683. In other embodiments, alternate metallic materials can be used including, but not limited to, steel, transformer iron, or nickel.

The laminations can be coated with a C4—AS antistick coating available from AK Steel Corp., or an equivalent coating. The coating is applied to the surface of the individual laminations in the current transformer's core prior to the punching and stacking operations. The coating provides an insulating barrier between the laminations that can withstand elevated temperatures during the annealing process. A primary function of the coating is to provide surface insulation between the layers of the stacked core, which prevents eddy currents from flowing from one lamination to the next. Eddy currents are undesirable, because they cause the resistive steel laminations to heat up. This heating reduces the current transformer's efficiency and requires a more expensive construction to withstand the additional heat rise. Application of a coating can also inhibit rusting to a certain extent.

FIG. 10 is a perspective view of a current transformer 1000 without a housing according to certain embodiments of the present disclosure. The current transformer 1000 includes a core 1030 comprising both solid laminations 1032 and gapped laminations 1035 combined in a single stacked core. A bobbin 1040 can be secured around the stacked laminations. In certain embodiments, a first lead pin 1022 and a second lead pin 1024 can be secured to the bobbin 1040 such that the pins 1022, 1024 extend vertically from the bobbin 1040.

The bobbin 1040 is placed around the core 1030, and a magnet wire 1050 is wrapped around the bobbin 1040. In certain embodiments, the wire 1050 is first wrapped approximately six turns around first lead pin 1022, then wound around the bobbin 1040, and then finished with approximately six turns around the second lead pin 1024. In certain embodiments, the wire 1050 can be wrapped around the bobbin 1040 for approximately 420 turns to achieve an approximate resistance of 12Ω. The magnet wire 1050 can be #32 AWG with heavy build polyurethane and a temperature requirement of 155° C.

In the exemplary embodiments illustrated in FIGS. 1-4, a circuit breaker, such as motor circuit protector 100, has three current transformers 210, 212, 214, each of which may correspond to any of the current transformers shown and described in connection with FIGS. 5-10. The current transformers can have iron cores and function to send current and to fault power the trip unit electronics. Each current transformer 210, 212, 214 senses different phase currents (traditionally labeled A, B, and C, each 120 degrees apart from one another) of the motor circuit protector 100. The number of secondary turns of wire 1050 about the bobbin varies and in certain embodiments ranges from 400 to 420 turns.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A current transformer apparatus for fault powering electronics coupled to the current transformer apparatus and for sensing a range of currents, the current transformer comprising a core including a plurality of solid laminations and a plurality of gapped laminations arranged back-to-back in a stack, wherein all of said plurality of gapped laminations are arranged back-to-back and all of said plurality of solid laminations are arranged back-to-back, each of the solid laminations having a central opening and each of the gapped laminations including a central opening and a gap or a notch formed along the surface of the gapped lamination, the number of the gapped laminations and the gap dimensions being selected to retain fault powering for solid-state electronics coupled to the current transformer and to sense the range of fault currents in response to a primary current being applied to a wire wound around the core, wherein the range of currents includes a lower current threshold and an upper current threshold, the ratio of the upper current threshold to the lower current threshold being at least 100:1.

2. The apparatus of claim 1, wherein the number of the solid laminations corresponds to a solid-to-gapped laminations ratio of 2:1 to 3:1.

3. The apparatus of claim 1, wherein the number of the gapped laminations corresponds to a gapped-to-solid laminations ratio of 2:1 to 8:1.

4. The apparatus of claim 1, wherein said range of currents sensed includes a current corresponding to a locked-rotor current or an in-rush current of a motor coupled to the current transformer apparatus and a fault current corresponding to an instantaneous short-circuit current.

5. The apparatus of claim 4, wherein the range of currents sensed is about 10 amps to about 3000 amps.

6. The apparatus of claim 5, said electronics including a solenoid powered by secondary current inductively induced from the primary current, said plurality of solid laminations and said plurality of gapped laminations comprising an iron alloy material, wherein said core is approximately 0.4 inches to 0.6 inches thick.

7. The apparatus of claim 6, further comprising:

a bobbin secured around said core and extending through said respective central openings of said solid lamination and said gapped lamination;

a first lead pin and a second lead pin secured to the bobbin such that the pins extend away from the bobbin;

the wire having a number of turns and wound around said bobbin; and a housing that at least partially encloses said core, said bobbin, and said wire, the first lead pin and the second lead pin protruding through the housing, the housing being dimensioned to fit within a housing of a circuit breaker into which the apparatus is installed.

8. The apparatus of claim 1, said electronics including a solenoid powered by secondary current inductively induced from the primary current.

9. The apparatus of claim 8, the wire having a number of turns, wherein said number of turns is at least 400.

10. The current transformer of claim 8, wherein a height dimension of the gapped laminations and the solid laminations does not exceed around 1.15 inches, and wherein a maximum width dimension of the gapped laminations and the solid laminations does not exceed one inch.

11. The apparatus of claim 1, said plurality of solid laminations and said plurality of gapped laminations comprising an iron alloy material, wherein said core is approximately 0.4 inches to 0.6 inches thick.

12. The apparatus of claim 1, further comprising:

a bobbin secured around said core and extending through said respective central openings of said solid lamination and said gapped lamination;

a first lead pin and a second lead pin secured to the bobbin such that the pins extend away from the bobbin;

the wire having a number of turns and wound around said bobbin; and a housing that at least partially encloses said core, said bobbin, and said wire, the first lead pin and the second lead pin protruding through the housing, the housing being dimensioned to fit within a housing of a circuit breaker into which the apparatus is installed.

13. The current transformer of claim 12, said electronics including a solenoid powered by secondary current inductively induced from the primary current, and wherein said range of currents sensed includes a current corresponding to a locked-rotor current or an in-rush current of a motor coupled to the current transformer apparatus and a fault current corresponding to an instantaneous short-circuit current.

14. The apparatus of claim 1, wherein each of said gapped laminations has a generally C-shape and at least three straight edge sections about a periphery of each of said gapped laminations.

15. The apparatus of claim 1, wherein each of said solid laminations is generally ring-shaped.

16. The current transformer of claim 1, wherein said range of currents includes a low current on the order of 9 or 10 amps and a fault current corresponding to an instantaneous short-circuit current, said electronics being housed within a circuit breaker and including a microcontroller and a solenoid both powered by secondary current inductively induced from said primary current, said microcontroller being programmed to, responsive to detecting said low current, cause said circuit breaker to trip.

17. The current transformer of claim 16, wherein said solid laminations and said gapped laminations are punched from the same die.

18. The current transformer of claim 1, wherein the nominal area of the each of the solid laminations does not exceed approximately 0.0607 square inches.

19. A motor circuit protector for interrupting the flow of electrical current to a motor, comprising:

a current transformer including a core having a central opening, the core having solid laminations stacked back-to-back together with gapped laminations stacked back-to-back, each of the gapped laminations having a gap formed along each respective surface of the gapped laminations;

wherein the current transformer senses a range of currents, wherein the range of currents includes a low current on the order of 9 or 10 amps and a fault current corresponding to an instantaneous short-circuit current such that a ratio of the fault current to the low current is at least 100:1, the low current corresponding to a locked-rotor or an in-rush current of the motor;

and an electronic circuit including solid-state electronics and a solenoid, the electronic circuit being powered by secondary current inductively induced from primary current by the current transformer, the solenoid operable to cause the motor circuit protector to interrupt the flow of current to the motor.

20. The motor circuit protector of claim 19, wherein the ratio of solid laminations to gapped laminations is at least 2:1.

21. The motor circuit protector of claim 19, wherein a height dimension of the gapped laminations and the solid laminations does not exceed around 1.15 inches, and wherein a maximum width dimension of the gapped laminations and the solid laminations does not exceed one inch.

22. A current transformer apparatus for fault powering electronics coupled to the current transformer apparatus and for sensing a range of currents, the current transformer comprising a core including a plurality of solid laminations and a plurality of gapped laminations arranged back-to-back in a stack, each of the solid laminations having a central opening and each of the gapped laminations including a central opening and a gap or a notch formed along the surface of the gapped lamination, the number of the gapped laminations and the gap dimensions being selected to retain fault powering for solid-state electronics coupled to the current transformer and to sense the range of fault currents in response to a primary current being applied to a wire wound around the core, wherein the range of currents includes a lower current threshold and an upper current threshold, the ratio of the upper current threshold to the lower current threshold being at least 100:1, wherein a height dimension of the gapped laminations and the solid laminations does not exceed around 1.15 inches, and wherein a maximum width dimension of the gapped laminations and the solid laminations does not exceed one inch.

* * * * *